US006829913B2

(12) United States Patent
Goldoni et al.

(10) Patent No.: US 6,829,913 B2
(45) Date of Patent: Dec. 14, 2004

(54) FABRIC CLEANING

(75) Inventors: Francesca Goldoni, Vlaardingen (NL); Jan Kevelam, Vlaardingen (NL); Arinus Frederikus Leerink, Vlaardingen (NL); Pieter W. van Reeven, Vlaardingen (NL); Pieter Van der Vlist, Vlaardingen (NL); Wendi Hutchinson, Leeds (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 316 days.

(21) Appl. No.: 10/113,728

(22) Filed: Apr. 1, 2002

(65) Prior Publication Data

US 2002/0178510 A1 Dec. 5, 2002

(30) Foreign Application Priority Data

Apr. 2, 2001 (GB) ..... 0108196
Oct. 29, 2001 (EP) ..... 01204121
Dec. 21, 2001 (EP) ..... 01205064

(51) Int. Cl.[7] ..... D06B 5/00

(52) U.S. Cl. ..... 68/5 A; 68/213; 68/214; 510/277

(58) Field of Search ..... 68/17 R, 213, 68/5 A, 63, 235 R, 214; 410/18; 206/229; 510/277, 406, 439

(56) References Cited

U.S. PATENT DOCUMENTS 2,164,965 A * 7/1939 Traube ..... 68/214
2,258,115 A * 10/1941 Kingman ..... 401/194
2,265,603 A * 12/1941 Kingman ..... 401/206
2,594,729 A * 4/1952 Carvalho ..... 401/202
3,046,593 A * 7/1962 Goldman ..... 401/202
3,124,825 A * 3/1964 Iovenko ..... 15/104.93
3,218,666 A * 11/1965 Maynard ..... 401/124
3,256,549 A * 6/1966 Evesque ..... 401/190
4,336,024 A * 6/1982 Denissenko et al. ..... 8/142
5,006,004 A * 4/1991 Dirksing et al. ..... 401/261
5,122,158 A 6/1992 Kuroda et al.
5,765,407 A * 6/1998 Choo et al. ..... 68/214
5,849,039 A * 12/1998 Sadlowski ..... 8/137
6,179,505 B1 * 1/2001 Oder et al. ..... 401/213
6,186,686 B1 2/2001 Neuner et al.
6,233,771 B1 * 5/2001 Hortel et al. ..... 8/150
6,375,686 B1 * 4/2002 Kim ..... 8/149.3
6,391,061 B1 * 5/2002 Hortel et al. ..... 8/137.5
6,450,724 B1 * 9/2002 Cambio ..... 401/270

FOREIGN PATENT DOCUMENTS

DE 1953714 * 4/1997
JP 7-100288 * 4/1995
WO 97/20099 6/1997
WO 99/02769 1/1999
WO 99/04082 1/1999
WO WO 99/46319 * 9/1999
WO 01/04260 1/2001
WO 01/04407 1/2001

OTHER PUBLICATIONS

International Search Report Application No. PCT/EP 02/03415 mailed Sep. 3, 2002.

* cited by examiner

*Primary Examiner*—Frankie L. Stinson
(74) *Attorney, Agent, or Firm*—Ronald A. Koatz

(57) ABSTRACT

A device for spot cleaning a fabric with a liquid cleaning composition, said device comprising at least one absorbent means for absorbing at least some of said composition from the fabric wherein the ratio of the working surface and the thickness or height of the absorbent means is preferably lower than 3000 mm. In a method of use, the liquid cleaning composition is applied to the fabric and some of the composition so applied is absorbed into the absorbent means.

24 Claims, 2 Drawing Sheets

FABRIC CLEANING

TECHNICAL FIELD

The present invention relates to a method, a liquid cleaning composition and a device for spot cleaning of a fabric.

BACKGROUND OF THE INVENTION

In recent years, there has been interest in providing products for spot removal of stains on fabrics, particularly garments. This may for example be for removal of stains due to food spillage or other stains which are stained during wear, as well as the localised cleaning of collars and cuffs prior to a main wash. As used herein, in the broadest sense, "spot cleaning" refers to cleaning of any part of a fabric other than the whole item.

U.S. Pat. No. 5,122,158 discloses a method and device for accelerating cleaning of soiled parts of clothes by rub coating with an enzyme-containing liquid detergent. An applicator device comprises a container closed by a porous body made of a heated and sintered synthetic plastics material. This is used to rub the garment to apply the liquid composition.

WO-A-97/20099 discloses a method of treating a spot or stain on a textile by applying a detergent composition, then placing an absorbent layer adjacent to one side of the textile fabric in the region of the spot or stain and applying heat, pressure or both to the opposing side. The detergent composition is applied in the form of a liquid composition, preferably comprising an organic solvent, optionally also containing a surfactant. The composition is dispensed from a container closed by an applicator device such as a porous plug with fabric or brush texturing, or a roller-ball device.

WO-A-99/02769 discloses a method for spot cleaning a stain spot on a fabric by wiping with an applicator impregnated with a cleaning solution comprising water, an alcohol, glycol, glycol-ether or glycerine and from 0.0001–1% by weight of surfactant. The applied solution is allowed to migrate outwardly from the spot and the volatile components evaporate. The wiping applicator is preferably stored in an airtight container and is preferably a polymer towelette. The cleaning solution may also contain enzyme. This product has a disadvantage of felting of the wipe if too much pressure is applied. Further, outward migration of the solvent tends to produce a "halo" effect on drying. Moreover, when a towelette is contacted with a stain and the stain is absorbed, it typically spreads in the same plane as the working surface of the towelette roughly in an increasing circle and often redeposits on the fabric to be cleaned.

WO-A-01/04260 discloses a fabric treatment applicator which is constructed in a form generally analogous to a felt-tipped pen. A synthetic fibre nib is used to apply a liquid composition contained in the body of the pen-like device. The liquid composition must contain at least one bleach and at least one surfactant. The absence of means to absorb the applied solution means that soil is largely redistributed on the fabric rather than removed.

WO-A-01/04407 discloses and claims an applicator for applying a spot-treatment stain removal aqueous solution to a textile fabric. The liquid composition preferably contains a bleach and the application device is preferably a nib. The application device must have a frictional stress of from 0.05 N mm-2 to 10 N mm-2. Again, the absence of means to absorb the applied solution means that soil is largely redistributed on the fabric rather than removed.

Other applicators are simply too hard and may damage delicate fabrics during the cleaning process. Alternatively, applicators may be too soft and felt during the cleaning process leaving unsightly residues. Thus there is a continuing need for a method of spot cleaning fabric which delivers effective spot cleaning, good garment care and/or without the need to rinse.

Furthermore, none of the prior proposals teaches an apparatus whereby a cleaning composition can be applied to a spot or stain on a textile fabric in optimal manner and then absorbed, together with stain material, using the same device and without the need for a separate absorbent pad or cloth which is not convenient for cleaning garments whilst being worn. Unexpectedly, we have found a method and device for spot cleaning fabric which overcomes one or more of drawbacks mentioned above.

DEFINITION OF THE INVENTION

Thus, according to one aspect of the present invention, a device and method for spot cleaning a fabric with a liquid cleaning composition is provided, said device comprising at least one absorbent means for absorbing at least some of said composition from the fabric wherein the ratio of the working surface and the thickness or height of the absorbent means is preferably lower than 3000 mm.

According to another aspect of the invention, a method for spot cleaning a fabric with a liquid cleaning composition is provided comprising the steps of a) applying the composition to the fabric b) absorbing at least some of the applied liquid cleaning composition from the fabric with an absorbent means whereby the absorbent means is capillary active in a plane different to the working surface of the absorbent means.

According to another aspect of the present invention a device for spot cleaning a fabric with a liquid cleaning composition is provided, the device comprising a reservoir for holding the composition, an applicator for applying the composition from the reservoir to the fabric and absorbent means for absorbing at least some of the applied liquid cleaning composition from the fabric wherein the absorbent means is preferably according to the previous aspect of the invention.

According to yet another aspect of the present invention a method of spot cleaning a fabric is provided said method comprising applying a liquid cleaning composition to the fabric with an applicator or a device according to the previous aspect of the present invention, and absorbing at least some of the applied liquid cleaning composition with the absorbent means of said device.

According to yet another aspect of the invention, a method and device for spot cleaning a fabric with a liquid cleaning composition suitable for multiple uses is provided, said device comprising more than one absorbent means for absorbing at least some of the applied composition from the fabric and holding means for storing the more than one absorbent means.

According to still another aspect of the invention, a method and liquid cleaning composition for spot cleaning a fabric with liquid cleaning composition is provided comprising the steps of a) applying the composition to the fabric wherein the liquid cleaning composition comprises from 0.001 to 2 wt. %, preferably from 0.01 to 1.5 wt. %, more preferably from 0.05 to 0.9 wt. % of a amphoteric or zwitterionic surfactant;

from 0.001 to 2 wt. %, preferably from 0.01 to 1.5 wt. %, more preferably from 0.05 to 0.9 wt. % of a nonionic surfactant;

from 0 to 2 wt. % preferably from 0.01 to 1.5 wt. %, more preferably from 0.05 to 0.9 wt. % of an anionic surfactant; and b) absorbing the excess liquid cleaning composition with an absorbent means.

The method, device and liquid cleaning composition according to the invention deliver effective spot cleaning by for example effectively absorbing the stain material, reducing the redeposition of the stain on the fabric to be cleaned, while being safe to delicate fabrics and/or leaving no unwanted residues.

We may also claim the device of this aspect of the invention in the form where the reservoir actually contains the liquid cleaning composition. These and other aspects of the invention are described in more detail below.

DETAILED DESCRIPTION OF THE INVENTION

We have unexpectedly found an improved method for spot cleaning a fabric with a liquid cleaning composition comprising the steps of a) applying the composition to the fabric b) absorbing at least some of the applied liquid cleaning composition from the fabric with an absorbent means whereby the absorbent means is capillary active in a plane different to the working surface of the absorbent means. Preferably said plane is perpendicular to the working surface of the absorbent means as defined below.

The absorbent means must be capable of absorbing the applied liquid cleaning composition from the fabric, preferably having at least some of the stain dissolved or dispersed therein if the stain dissolves or disperses in the cleaning liquid. With bleachable stains obviously none of the stain may be absorbed. In that case it is desirable that the absorbent means is able to absorb the excess cleaning liquid applied to the stain. The liquid cleaning composition may be applied in any suitable way for example with a special applicator. However, it may be convenient to combine these such that the liquid cleaning composition is applied from a device for spot cleaning a fabric and said device also comprises said absorbing means. The device may also comprise more than one absorbing means as described below. Usually the absorbent means will comprise fibres. A fibre can be made of any substance, natural, or manmade, and has a high length-to-width ratio. Towelettes and wipes may also comprise fibres, but these fibres are typically oriented randomly but in the same plane as the working surface of the towelette or wipe.

One of the advantages of the absorbent means according to that aspect of the invention is that it can be used to rub the applied cleaning liquid on the stain. For some stains, the process for spot cleaning preferably includes rubbing the applied cleaning liquid on the stain with the absorbent means thereby dissolving or otherwise removing the stain and, more or less at the same time, absorbing at least some of the excess liquid and loosened stain material, if any. Thus, the fabric which is spot cleaned according to the present invention does not have excess cleaning liquid and does not need rinsing. The absorbent means should preferably have such a combination of absorbing capacity and dimensions to be able to absorb at least 0.2 ml more preferably, at least 0.4 ml most preferably at least 0.6 ml of the used cleaning liquid. In contrast to 2 dimensional wipes which can also be described as a layer, sheet web or laminate, the absorbent means according to that aspect of the invention is preferably a body, i.e., 3 dimensional object with sufficient height to absorb these quantities. This height or thickness will depend on the exact nature of the absorbing means such as the absorbing capacity of the material used and the way it is processed and structured. Often, the height of the absorbing means is from 1 to 50 mm, more preferably from 2 to 30 mm, most preferably from 3 to 20 mm. The body of the absorbent means may have any form suitable for this purpose. One preferred form is a disc form having a diameter of from 0.5 to 5 cm, more preferably from 0.7 to 3 cm most preferably from 0.9 to 2 cm. The working surface of the absorbent means may have any suitable form but is preferably flat. It may also be cone shaped or even curved like for example when the body has a dome shape.

According to one aspect of the invention, the absorbent means comprises a capillary active continuous body of fibres which are as a whole longitudinally aligned, and which are, in the aggregate, in a parallel orientation.

As used herein the terms capillary and capillarity are used to refer to passageways within the absorbent means which are capable of liquid transport in accordance with the principles of capillarity generally represented by the Young/Laplace equation. This equation states that fluids will rise in a channel or column until the pressure differential between the weight of the liquid and the forces pushing it through the channel are equal.

$$Dp=(2g \cos q)/r$$

In the equation, Dp is the capillary pressure differential across the surface, g is the surface tension of the liquid, q is the contact angle between the liquid and the walls of the channel, and r is the radius of the cylinder.

Capillary active absorbent means comprising fibres forming capillary active passageways can be used advantageously by transporting liquid effectively in a short period of time away from the working surface and minimise the redeposition of cleaning liquid and any stain material.

According to one preferred embodiment, the capillary active absorbent means comprises of fibres which are oriented parallel to each other and perpendicular to the working surface of the absorbent means. Just to avoid confusion, the term "perpendicular to the working surface" intended to describe the general orientation of the fibres independent from the exact form of the absorbent means as the exact form may differ in different embodiments. For this purpose, we start from the absorbent means having a cylindrical form whereby the ends are flat. The end of such a cylinder can be used as the working surface. The term "perpendicular to the working surface" is intended to describe that the longest axis of the fibres or capillary activity makes an angle of between 70 and 110 degrees with the working surface of the absorbent means at least at the point of contact with the working surface. It is desirable that the fibres are continuous over the height or thickness of the absorbent means. The uniformity of the continuity or orientation of the fibres will depend on various factors such as the exact method of processing the fibres and the absorbent pad. Usually more than 50% of the fibres will be continuous respectively oriented parallel to each other and perpendicular to the working surface of the absorbent means at the point of contact. The fibres or filaments may also be twisted whereby the longitudinal axis is preferably still oriented perpendicular to the working surface of the absorbent means. Preferable absorbent means comprising twisted yam fibres and a process for the preparation thereof are for example described in WO 89/05235 and U.S. Pat. No. 4,729,808. Obviously, it is intended that the invention encompasses embodiments whereby the absorbent means are processed into another form than a cylinder or disc. The ends of a cylinder may for instance be processed to form a dome or a cone shape. Alternatively, starting from a cylinder, this cylinder may be transsected under an angle of less than 90 degrees with the longitudinal axis. The skilled person may choose any suitable form starting from the absorbent means as defined according to that aspect of the invention.

In general, many fibrous materials developed for use as filters in cigarettes or for use in the ink industry such as ink reservoirs may be suitable depending on the requirements described. For example, the fibres of the absorbent means may be a filamentary tow as defined in U.S. Pat. No. 3,094,736 forming a continuous body of fibres "randomly oriented primarily in a longitudinal direction." The term "randomly oriented primarily in a longitudinal direction" as used in this specification and the appended claims, is intended to describe the condition of a body of fibres which are as a whole longitudinally aligned, and which are, in the aggregate, in a parallel orientation, but which have short portions running more or less at random in non-parallel diverging and converging directions.

Normally, the absorbent means will comprise of continuous fibres or filaments randomly oriented primarily in a longitudinal direction, preferably perpendicular to the working surface as described in U.S. Pat. No. 3,111,702. Alternatively, the absorbent means may be formed of coherent sheet of flexible thermoplastic fibrous material composed of an interconnecting network of randomly arranged, highly dispersed, continuous-filament junctions as described in U.S. Pat. No. 4,729,808.

Preferable absorbent means include, but are not limited to, absorbent means prepared from Transorb™ material available from American Filtrona Corporation such as Transorb Reservoir R20865. Preferably, the material for the fibres may be selected from the group comprising polyethylene, polypropylene, polyester, polyolefin cellulose acetate material and mixtures thereof.

According to one aspect of the invention an unexpectedly effective method and absorbent means for spot cleaning a fabric with a liquid cleaning composition is provided. We have found that the ratio of the working surface and the thickness or height of the absorbent means is preferably lower than 3000 mm. More preferably, this ratio is from 0.01 to 3000 mm, even more preferably from 0.05 to 1000, most preferably from 0.1 to 500 mm. When the working surface is not a single flat plane, the working surface can be defined as the contact area is defined in WO-A-01/04260. If the thickness of the working surface is variable, preferably the maximum thickness should be taken. Thus one preferable method for spot cleaning a fabric with a liquid cleaning composition comprises a) applying the composition to the fabric;

b) absorbing at least some of the applied liquid cleaning composition from the fabric with an absorbent means whereby ratio of the working surface and the thickness or height of the absorbent means is preferably lower than 3000 mm. Desirable features of the absorbent means and method are as described above.

The absorbent means is preferably part of a device for spot cleaning a fabric. The device may have any form as long as it is suitable for spot cleaning a fabric. Preferably, the device comprises holding surfaces so it can be used as a hand held device during the process of spot cleaning like for example a pen or even an eraser. Preferably, the device also comprises a holding means to hold the absorbent means. The absorbent means may for example be held in a chamber, compartment, recess, on support member or a surface of the device by any suitable means. The absorbent means may be glued, simply wedged or held by any other suitable manner in the holding means. The holding means for the absorbent means is preferably a non detachable part of the device. The absorbent means will usually be much smaller than the device. So small that the absorbent means itself may be difficult to hold when it is rubbed against the stain. One advantage according to this aspect of the invention is that the absorbent means is held in place by the holding means of the device and the user can still transfer an effective force to remove the stain by holding the device and rubbing the absorbent means, optionally covered by mesh means, against the stain.

According to another aspect of the present invention a device for spot cleaning a fabric with a liquid cleaning composition is provided, the device comprising a reservoir for holding the composition, an applicator for applying the composition from the reservoir to the fabric and absorbent means for absorbing at least some of the applied liquid cleaning composition from the fabric wherein the absorbent means is preferably as described above.

The body of the device may be in any convenient shape, e.g. elongate, spherical or partly spherical or having any aesthetically appealing or novelty shape. However, most preferably, the device is in the form of a member having a first end and a second end, wherein the reservoir is located within or forms at least part of the member. Thus, the first and second ends may be respective ends of a tubular or other elongate member having any cross-section. It may also have one or more bends or angles therein, e.g. so that one part can act as a handle whilst the other end is being applied to the fabric.

In a preferred embodiment, one of the applicator and the absorbent means is located at the first end of the member and the other is located at the second end of the member. Alternatively, in another preferred embodiment, both the applicator and the absorbent means are located at the same first end or second end of the member. In that case, one of the applicator and the absorbent means may be arranged concentric to the other, and preferably also with at least the adjacent part of the reservoir member, for simplicity of use. The arrangement may also be such that the applicator has a point or region of exit for the composition and the absorbent means surrounds the point or region of exit.

In yet another preferred embodiment, a device for spot cleaning a fabric with a liquid cleaning composition suitable for multiple uses is provided, the device comprising more than one absorbent means for absorbing at least some of the applied liquid cleaning composition from the fabric and holding means for holding or storing more than one absorbent means. Preferably, the device further comprises a reservoir for holding the composition, an applicator for applying the composition from the reservoir to the fabric, The holding means may store 2 or anything up to 15 absorbent means. The more than one absorbent means can each be conveniently used for separate stains but if desired for one stain. Preferably, the holding means stores the absorbent means in such a way that at least one absorbent means can be used directly. The form of the holding means will depend on the form of the absorbent means. For example, when the absorbent means have the form of discs, the holding means may have the form of a column to hold say 4 to 10 discs stacked on each other whereby the absorbent disc facing out, can be used directly. The absorbent means may be absorbent on one side but impermeable on the other to prevent cross contamination of other absorbent means when these are stacked.

It is desirable that the device also includes discarding means to discard the used disc and preferably at the same time to position a subsequent unused absorbent means for use. The discarding and/or positioning means may for example include material with a spring action in the bottom of the storage means or other systems known to the skilled person used for lipsticks or deodorant stick dispensers. For example, a system where by rotating the holding means of the device vis a vis another part of the device, the rotation is translated into an axial movement of an elevator means located in the holding means, elevating a number of absorbent means held by the holding means whereby the most outward facing absorbent means is discarded and at the same time a fresh absorbent means is exposed and positioned for use. The device may also comprise a removable cap to protect the absorbent means in between uses. The reservoir for the cleaning liquid will preferably comprise sufficient cleaning liquid for the multiple uses and will be reclosable for example with a removable cap. Both the reservoir and holding means may be designed to allow refilling by the consumer.

Preferably, mesh means is also provided for rubbing the fabric so that the liquid absorbed by the absorbent means from the fabric passes through the mesh means. The absorbent member is conveniently held in a chamber having an opening covered by a mesh means. Alternatively, the absorbent means may be mounted on a support member and covered by the mesh means. In a coaxial form of such an arrangement, an outlet of the applicator may pass through the support and absorbent means. The mesh can assist soil removal by rubbing. The loosened soil then passes through the mesh to be absorbed by the absorbent means, before it can be redistributed on the fabric. Further, hydrophobic soil such as lipstick can be removed by adhering directly to the mesh means. If a mesh means is not present, such hydrophobic soil will be directly absorbed by the absorbent means and/or adhere to it.

The mesh means is preferably a mesh of natural or synthetic polymer e.g. made of polyethylene, polyester or nylon The mesh size is to be understood as the opening or clear space between the wires. Preferably the average mesh size is greater than 200, preferably greater than 250, more preferably greater than 300 micrometers. The average mesh size is preferably smaller than 2000, more preferably smaller than 1500 and even more preferably smaller than 1000 micrometers. A mesh thickness of from 50 micrometers to 500 micrometers is typical and is preferably of from 150 micrometers to 400 micrometers. The wire diameter is preferably from 50 micrometers to 500 micrometers and is more preferably from 150 micrometers to 400 micrometers. The mesh means may even be a coarsely woven fabric.

The applicator closes the reservoir but allows the liquid composition to flow-out in controlled manner. It may for example, comprise a simple slot or hole of dimensions such that the out-flow of the liquid composition is restricted. It can also comprise a nib of metal or plastics construction, or a permeable member such as of foam or sintered composition or a fibre member. Optionally, a snap-off, pull-off or cut-off seal or else a cap or plug may be provided for sealing before first use. After opening, a removable cap may be provided for covering the applicator before repeat use, so that liquid cannot evaporate or escape.

To assist removal of the composition from the reservoir, the reservoir may in whole or in part, be formed of a flexible material so that it may be squeezed. The reservoir may also be provided with a plunger (e.g. rod and piston) arrangement to assist dispensing of the liquid.

The liquid composition is preferably aqueous, although the present invention also extends to compositions wherein a substantially non-aqueous liquid composition is applied, e.g. having less than 25% by weight or less, preferably 20% by weight or less, more preferably 15% by weight or less, e.g. 10% by weight or less, most preferably 5% by weight or less of water.

In the case of the aqueous compositions, it is also preferred to have at least one organic solvent present, which preferably should be water-miscible. Preferred organic solvents are selected from alcohols, ketones, esters, glycol ethers and mixtures thereof. If present, preferably the organic solvent content is from 0.1 to 75% by weight of the composition, more preferably from 1% to 10% by weight.

It is also preferred in some embodiments for the composition to contain a surfactant component comprising one or more surfactants selected from an ionic, cationic, zwitterionic and amphoteric surfactant. In general, surfactants can be selected from those known in the art of laundry detergent compositions. When present, the surfactant component is preferably present from 0.00001% to 10%, more preferably from 0.0001% to 1% by weight of the composition. The presence of surfactant is beneficial for removing oily stains from hydrophobic fabrics such as polyester. However, the case of oily stains on hydrophilic fabrics such as cotton, it may be preferably to avoid surfactant, i.e. to have less than 1 wt %, preferably less than 0.1 wt. %, most preferably no surfactant by weight of the liquid cleaning composition.

According to one aspect of the invention surprisingly effective liquid cleaning composition and method for spot cleaning a fabric with said liquid cleaning composition is provided, the method comprising the steps of a) applying the composition to the fabric wherein the liquid cleaning composition comprises i) from 0.001 to 2 wt. %, preferably from 0.01 to 1.5 wt. %, more preferably from 0.05 to 0.9 wt. % of a amphoteric or zwitterionic surfactant;

ii) from 0.001 to 2 wt. %, preferably from 0.01 to 1.5 wt. %, more preferably from 0.05 to 0.9 wt. % of a nonionic surfactant;

iii) from 0 to 2 wt. % preferably from 0.01 to 1.5 wt. %, more preferably from 0.05 to 0.9 wt. % of an anionic surfactant; and b) absorbing the excess liquid cleaning composition with an absorbent means.

Preferably, the liquid cleaning composition comprises an amphoteric surfactant such as a betaine surfactant. It will be obvious that this aspect of the invention can be combined with the features of other aspects of the invention such as the absorbent means or device for spot cleaning.

For effective cleaning, it is advantageous for the viscosity of the liquid composition to be preferably from 0.1 mPaS to 1000 mPaS, more preferably from 10 mPaS to 500 mPaS. If the inherent viscosity of the composition is not already within such a range, a thickener e.g. of polymeric type may be included. For the avoidance of doubt, in the case of non-Newtonian liquid compositions (which is preferable), the viscosity is that measured at a shear rate of 100s-1.

Optionally, other components may be dissolved or dispersed in the liquid compositions, e.g. selected from detergency builders, bleaches and bleach systems, enzymes, fluorescers and other materials which are conventional in laundry wash compositions for hand or machine washing.

The pH of the liquid cleaning composition is preferably from 3 to 10, more preferably from 5 to 9, most preferably from 6 to 8.

The amount of liquid cleaning composition in the reservoir means is sufficient for the number of uses the device is designed for. For example 0.1 to 2 ml per single use. Preferably from 0.001 to 10 ml or even 20 ml, more preferably from 0.1 ml to 5 ml or even 0.1 to 1 ml for a single use. For a device designed for 8 uses a reservoir of 14 ml would usually be sufficient.

For the avoidance of doubt, any feature of one aspect of the present invention may be utilised in any other aspect of the invention.

The present invention will now be explained in more detail by way of the following description of preferred embodiments, and with reference to the accompanying drawings.

DESCRIPTION OF THE PREFERRED EMBODIMENTS

Figure 1:
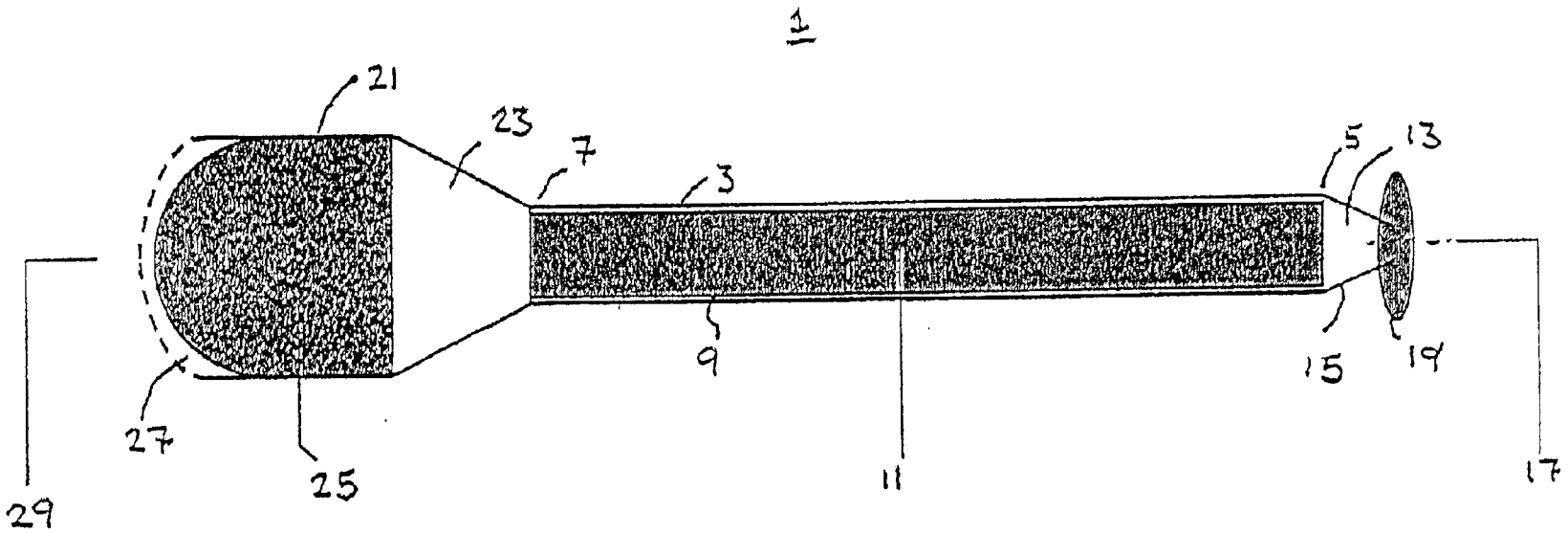
FIG. 1 shows a cross-section through a first embodiment of a device according to one aspect of the present invention.

As shown in FIG. 1, there is shown a first embodiment of a spot cleaning device 1 according to the present invention. Overall, it is of a size to be hand-held The device comprises an elongate member 3 having a first end 5 and a second end 7. The elongate member 3 contains a reservoir 9 into which is filled a liquid cleaning composition 11.

At the first end 5 of the elongate member 3, is located an applicator 13 which comprises a frusto-conical extension 15 of the elongate member 3 and integral therewith, narrowing to a restricted opening 17. This restricted opening is sealed before sale and use with a snap-off member 19.

At the second end 7 of the elongate member 3, there is attached thereto, a chamber member 21 attached to the elongate member by a frusto-conical section 23. Thus, the elongate member 3 and the chamber 21 and frusto-conical connector 23 are cylindrical in cross-section but the chamber member 21 is of wider diameter than the elongate member 3.

Contained within the chamber 21 is an absorbent disc of Transorb Reservoir R20865 ex American Filtrona Corporation 25. Optionally, this may also occupy the frusto-conical section 23. The chamber member 21 has an open end 27 which is closed by a mesh (net) 29 made of nylon. The mesh size is approximately 450 micrometers. The mesh size is in any event smaller than the average particle size of the polymer 25. The elongate member 3, frusto-conical sections 15 and 23 and the chamber 21 together with the snap-off member 19 are conveniently moulded as one-piece construction, e.g. by injection moulding of high density polypropylene.

In use, the consumer snaps-off member 17 and tips the device so that an appropriate amount of liquid cleaning composition is dispensed through narrow opening 17 to the stain. The pen is then inverted and the stain and surrounding fabric, which is wetted with the liquid composition, is rubbed/scrubbed with the mesh member 29. In this way, the liquid composition on the fabric, together with stain material dispersed or dissolved therein, is absorbed into the absorbent polymer 25 and/or the soil adheres to the mesh and/or polymer.

Figure 2:
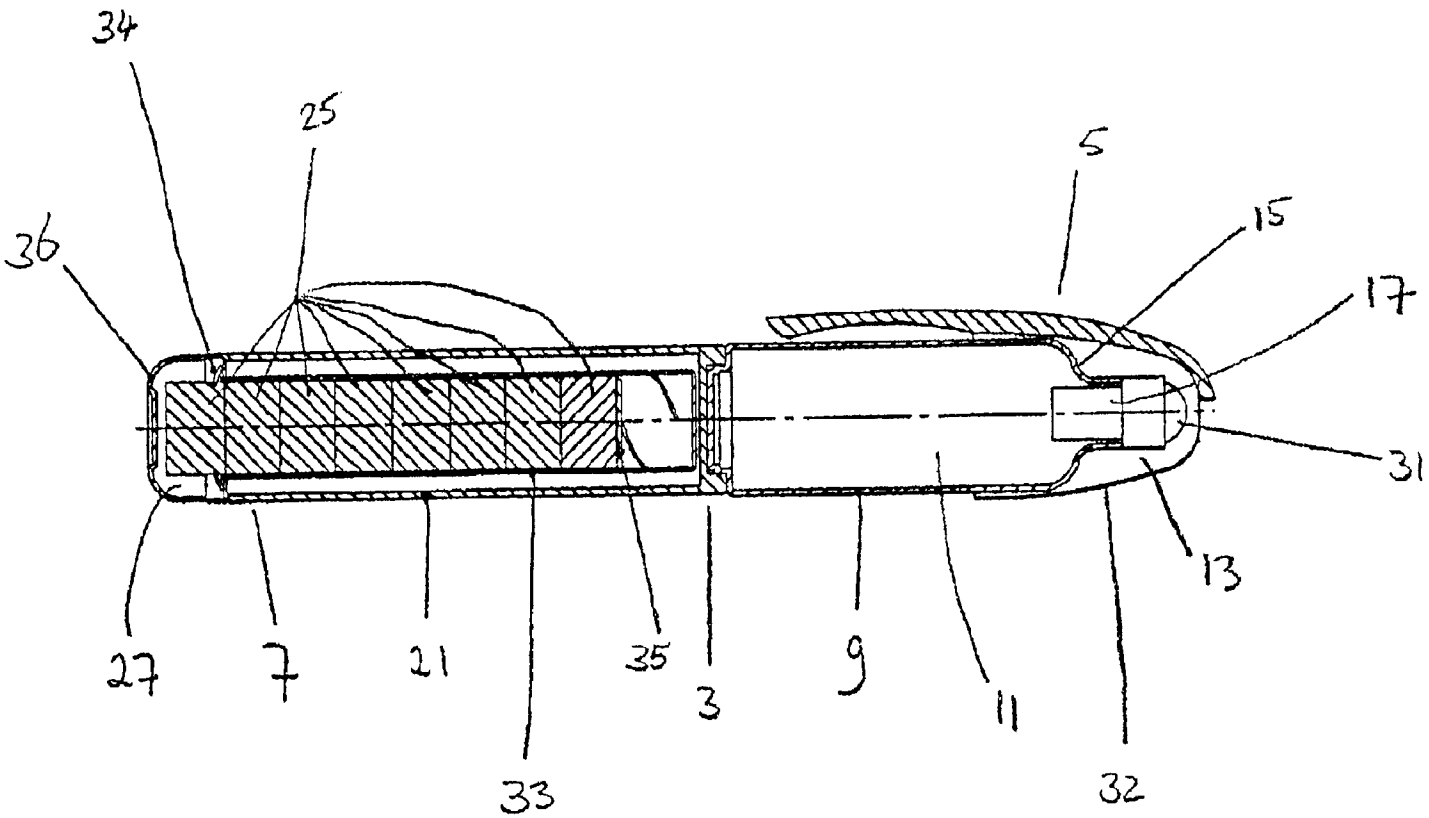
FIG. 2 shows a cross-section through a second embodiment of a device according to another aspect of the present invention.

Now turning to FIG. 2, there is shown a cross section of a second embodiment of a spot cleaning device for multiple use according to one aspect of the present invention in the form of a pen. The total length is 151.19 mm and the outer diameter is 23.75 mm.

The device comprises an elongate member 3 having a first end 5 and a second end 7. The elongate member 3 contains applicator 13 and a squeezable reservoir 9 (14 ml) into which is filled a liquid cleaning composition 11.

At the first end 5 of the elongate member 3, is located an applicator 13 which comprises a frusto-conical extension 15 of the elongate member 3 and integral therewith, narrowing to a restricted opening 17 with roll-on applicator 31 (Dab-O-Matic® assembly). Applicator 13 is closed with a removable cap 32

At the second end 7 of the elongate member 3, there is a chamber member 21 rotatably connected to reservoir 9. Contained within the chamber 21 is eight absorbent discs 25 of Transorb Reservoir R20865 (ex American Filtrona Corporation) within inner sleeve33. Optionally, each disc may be covered by mesh means. The discs inside chamber member 21 are held by inner sleeve 33 attached to reservoir 9. The chamber member 21 has an open end 27 wherein disc 25 is retained by retaining ring 34. When the device is not used a removable cap 36 protects the absorbent disc 25 facing out. After use, a disc may be discarded by rotating chamber member 21 vis a vis the reservoir 9 to elevate elevator 35 within inner sleeve 33 thereby ejecting an absorbent disc and at the same time exposing a fresh disc for use. Inner sleeve 33, chamber member 21 and elevator 35 are engaged in such a manner that rotation of the chamber member 21 is translated into an axial movement of the elevator. Reservoir 9 and chamber 21 may be refillable.

The liquid cleaning composition 11 used in the above embodiments may have the following formulation:

Example 1

| Trade Name | Supplier | Material Type | wt. % |
|---|---|---|---|
| Permulen TR 2 | BF Goodrich | polymeric emulsified | 0.1 |
| Lialet 111-5.5 | Condea Augusta | nonionic surfactant | 0.2 |
| Admox 12 | Albermarle | tertiary amine oxide | 0.15 |
| Sodium dioctyl sulfosuccinate | Sigma | wetting agent | 0.3 |
| KOH | Baker | pH control (to pH = 7.0) | 0.021 |
| Kathon CG-ICP | Rohm & Haas | Biocide | 0.0003 |
| Water | | | balance |

Example 2

| Trade Name | Supplier | Material Type | wt. |
|---|---|---|---|
| Permulen TR2 | BF Goodrich | Polymeric emulsifier | 0.10 |
| Lialet 111-5.5 | Condea Augusta | Nonionic surfactant | 0.20 |
| Admox 12 | Albemarle | Tertiary amine oxide | 0.15 |
| Sodium dioctyl sulfo succinate | Sigma | Anionic surfactant/wet | 0.30 |
| Kathon CG-ICP | Rohm and Haas | Biocide | 0.0003 |
| KOH | | | to pH 7.0 |
| Water | | | balance |

-continued

Example 3

| Trade Name | Supplier | Material Type | Chemical structure | wt. |
|---|---|---|---|---|
| Imbentin AG-124S/065 | Dr Kolb AG | Nonionic surfactant | C<12–14>, 6.5 mol EO | 0.47 |
| Amphoteen 24 | Akzo Nobel | Amphoteric surfactant | Coco di-methylbetaine | 0.13 |
| Nansa HS 90 PF | Albright & Wilson | Anionic surfactant | C10–C14 benzene sulphonate, Na salt | 0.05 |
| Kathon CG/ICP | Rohm and Haas | Preservative | Preservative; class of iso-thiazolinones | 0.00075 |
| Disodium EDTA | J. T. Baker | Buffer, chelating agent, preservative | Disodium EDTA | 0.1 |
| KOH | | | | pH to 7 |
| Water | | | | Balance |

Example 4

| Trade Name | Supplier | Material Type | wt. |
|---|---|---|---|
| Permulen TR2 | BF Goodrich | Polymeric emulsifier | 0.10 |
| Lialet 111-5.5 | Condea Augusta | Nonionic surfactant | 0.20 |
| Admox 12 | Albemarle | Tertiary amine oxide | 0.15 |
| Dynol 604 | Air Products | nonionic surfactant/ wet | 0.30 |
| Kathon CG-ICP | Rohm and Haas | Biocide | 0.0003 |
| KOH | | | to pH 7.0 |
| Water | | | Balance |

In an alternative formulation, the amount of Permulen TR2 is 0.1 wt. and 0.75 wt. is the amount of Lialet 111-5.

EXAMPLE 5

Two drops (about 80 microlitres) of full fat chocolate milk (Chocomel ex Nutricia (NL)) are applied onto an absorbent material. The soiled absorber is left for 30 seconds and then pressed against a white cotton swatch for 1 second (CN1 ex CFT) using a range of pressures. The reflectance expressed as dE of the cotton swatch was measured before and after the treatment with the soiled absorber, as well as the diameter of the resulting stain and the amount of chocolate milk that was transferred.

A. Absorbent means: disc (diameter 13 mm, height 8 mm) of Transorb Reservoir R20865 ex American Filtrona Corporation.

| Pres. gr/cm^2 | Drop Weight Mg | Drop on textile mg |
|---|---|---|
| 800 | 57 | 5 |
| 500 | 57 | 8 |
| 200 | 81 | 7 |
| 200 | 52 | 3 |
| 100 | 70 | 1 |

B. Absorbent means: wipe of non-woven material SVS 49 (ex BFF Non wovens)

| Pres. gr/cm^2 | Drop Weight Mg | Drop on textile mg |
|---|---|---|
| 200 | 75 | 60 |
| 200 | 22 | 19 |

Absorbent means A according to that aspect of the invention performed better than comparative absorbent means B. Thus in case B, much more of the stain is relocated from the absorber into the cotton fabric. The transfer of the stain is significantly higher in case B, the stain is heavier and the diameter is larger.

EXAMPLE 6

Two drops (about 80 microlitres) of full fat chocolate milk (Chocomel ex Nutricia) are applied onto a glass plate. An absorbent material is contacted with the drop of chocolate milk by pressing it onto the soiled glass plate for 5 seconds (force 20 g/cm2). As a result, the absorber takes up a certain amount of chocolate milk. The soiled absorber is left for 30 seconds and ten pressed against a white cotton swatch for 1 second (CN1 ex CFT) using a force of 200 g/cm2. The reflectance of the cotton swatch was measured before and after the treatment with the soiled absorber, as well as the diameter of the resulting stain and the amount of chocolate milk that was transferred.

A. Absorbent means: disc (diameter 13 mm, height 8 mm) of Transorb Reservoir R20865 ex American Filtrona Corporation.

B. Absorbent means: wipe of non-woven material SVS 49 (ex BFF Non wovens)

Absorbent means A according to that aspect of the invention performed better than comparative absorbent means B showing less resoiling. Thus in case of B, much more of the stain was relocated from the absorber into the cotton, the stain was heavier and the diameter of the stain was larger.

What is claimed is:

1. A device for spot cleaning a fabric with a liquid cleaning composition, said device comprising at least one absorbent means for absorbing at least some of said composition from the fabric wherein the ratio of the working surface and the thickness or height of the absorbent means is preferably lower than 3000 mm;

wherein said device further comprises a reservoir for holding said liquid composition, and an applicator for applying the composition from the reservoir to the fabric;

wherein the absorbent means comprises fibers which are oriented parallel to each other and perpendicular to the working surface of the absorbent means.

2. A device according to claim 1, wherein said ratio is from 0.01 to 3000.

3. A device according to claim 1, wherein the device comprises more than one absorbent means for absorbing at least some of said composition from the fabric and holding means for storing the more than one absorbent means.

4. A device according to claim 1, wherein the device additionally comprises removable cap to protect the absorbent means in between uses.

5. A device according to claim 1, wherein the absorbent means is capillary active perpendicular to the working surface of the absorbent means.

6. A device according to claim 1, in the form of a member having a first end and a second end, wherein the reservoir is located within or forms at least part of the member.

7. A device according to claim 6, wherein one of the applicator and the absorbent means is located at one of said first and second ends of the member and the other of the applicator and the absorbent means is located at the other of the first and second ends of the member.

8. A device according to claim 6, wherein both the applicator and the absorbent means are located at the same first end or second end of the member.

9. A device according to claim 1, wherein said applicator comprises a slot or hole of dimensions for restricting the out-flow of the liquid composition.

10. A device according to claim 1, wherein a removable cap is provided for covering the applicator when not in use.

11. A device according to claim 1, wherein the liquid composition comprises water, at least one organic solvent and optionally, surfactant.

12. A method of spot cleaning a fabric by applying a liquid cleaning composition to the fabric with an applicator of a device according to claim 1 and absorbing at least some of the applied liquid cleaning composition so applied with the absorbent means of said device.

13. A method of spot cleaning according to claim 12, wherein mesh means is provided for rubbing the fabric so that liquid absorbed by the absorbent means from the fabric passes through the mesh means, wherein the mesh means is used to rub the fabric after application of the liquid composition.

14. A device for spot cleansing a fabric with a liquid cleansing composition, said device comprising at least one absorbent means for absorbing at least some of said composition from the fabric wherein the ratio of the working surface and the thickness or height of the absorbent means is preferably lower than 3000 mm;

wherein the device further comprises a reservoir for holding said liquid composition, and an applicator for applying the composition from the reservoir to the fabric;

wherein mesh means is provided for rubbing the fabric so that liquid absorbed by the absorbent means from the fabric passes through the mesh means.

15. A device according to claim 14, wherein said ratio is from 0.01 to 3000 mm.

16. A device according to claim 14, wherein the device comprises more than one absorbent means for absorbing at least some of said composition from the fabric and holding means for storing the more than one absorbent means.

17. A device according to claim 14, wherein the device additionally comprises removable cap to protect the absorbent means in between uses.

18. A device according to claim 14, wherein the absorbent means is capillary active perpendicular to the working surface of the absorbent means.

19. A device according to claim 14, in the form of a member having a first end and a second end, wherein the reservoir is located within or forms at least part of the member.

20. A device according to claim 19, wherein one of the applicator and the absorbent means is located at one of said first and second ends of the member and the other of the applicator and the absorbent means is located at the other of the first and second ends of the member.

21. A device according to claim 19, wherein both the applicator and the absorbent means are located at the same first end or second end of the member.

22. A device according to claim 14, wherein said applicator comprises a slot or hole of dimensions for restricting the out-flow of the liquid composition.

23. A device according to claim 14, wherein a removable cap is provided for covering the applicator when not in use.

24. A device according to claim 14, wherein the liquid composition comprises water, at least one organic solvent and optionally, surfactant.

* * * * *